US006418666B1

(12) United States Patent
Pfanzer et al.

(10) Patent No.: US 6,418,666 B1
(45) Date of Patent: Jul. 16, 2002

(54) ADJUSTING DEVICE

(75) Inventors: Gerhard Pfanzer, Bag Camberg; Mark Schiebelhuth, Frankfurt; Alfred Wipfler, Kriftel, all of (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/586,429

(22) Filed: Jun. 2, 2000

(30) Foreign Application Priority Data

Jun. 5, 1999 (DE) ..... 199 25 741

(51) Int. Cl.[7] ..... E05F 11/00
(52) U.S. Cl. ..... 49/324; 49/340
(58) Field of Search ..... 49/324, 325, 349, 49/352, 340; 464/180, 153, 154

(56) References Cited

U.S. PATENT DOCUMENTS

| | | | | | |
|---|---|---|---|---|---|
| 2,860,497 | A | * | 11/1958 | Parks | 464/180 |
| 4,186,524 | A | * | 2/1980 | Pelchat | 49/324 |
| 4,722,631 | A | | 2/1988 | Tagami | |
| 4,747,796 | A | * | 5/1988 | Iwai et al. | 440/83 |
| 5,203,113 | A | * | 4/1993 | Yagi | 49/324 |
| 5,354,237 | A | * | 10/1994 | Amborn et al. | 464/180 |
| 5,385,061 | A | * | 1/1995 | Moy et al. | 74/42 |
| 5,680,728 | A | * | 10/1997 | Moy | 49/324 |
| 5,901,500 | A | * | 5/1999 | Tsuda et al. | 49/324 |
| 6,032,418 | A | * | 3/2000 | Larson | 49/333 |
| 6,056,348 | A | * | 5/2000 | Tsuda et al. | 296/146.16 |
| 6,073,995 | A | * | 6/2000 | Klein | 296/216.02 |
| 6,195,940 | B1 | * | 3/2001 | Moy | 49/324 |

FOREIGN PATENT DOCUMENTS

| | | |
|---|---|---|
| DE | 2321158 | 10/1973 |
| DE | 4208126 | 9/1992 |
| DE | 69200570 | 5/1995 |
| DE | 29604293 | 8/1997 |

* cited by examiner

*Primary Examiner*—Curtis A. Cohen
(74) *Attorney, Agent, or Firm*—Martin A. Farber

(57) ABSTRACT

An adjusting device serves for moving a moveable part into various positions, for example a side ventilator window of a motor vehicle. A servomotor (14) drives a spindle drive (18) which comprises essentially a spindle (24) having an external thread (26) and a sleeve part (28) which surrounds the spindle and has a corresponding internal thread (30). When acted upon by an external force, axial play in the region of the spindle drive (18) may lead to noise being produced; in order to avoid the noise, one (30) of the two threads comprises separate threaded parts (32, 36), and an elastically prestressable element (38) is provided with the aid of which an axial force can be produced between the two threaded parts (32, 36). The axial force causes the two threaded parts (32, 36) each to bear against opposite flanges of the external thread (26), so that the axial thread play is eliminated.

10 Claims, 1 Drawing Sheet

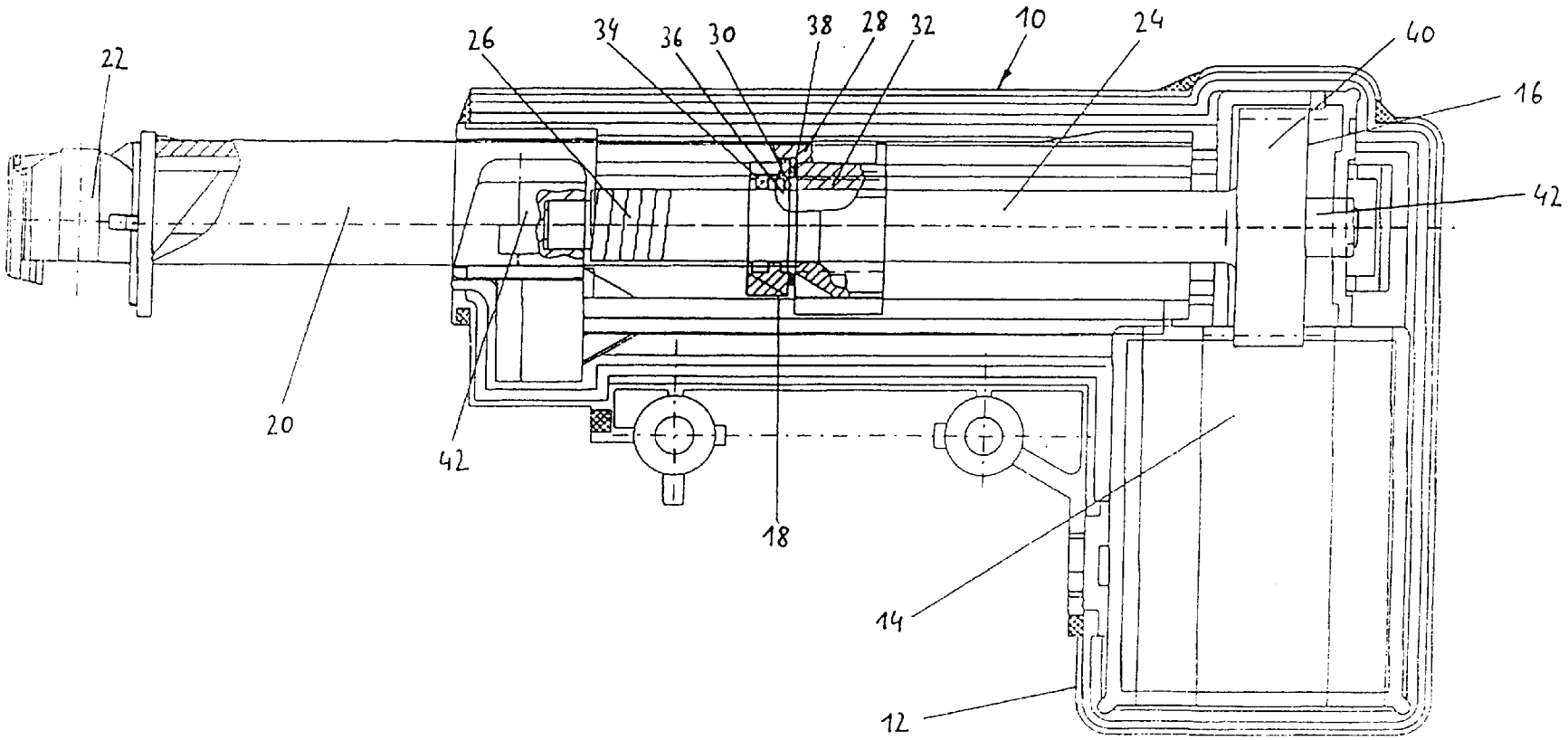
16
42
40
24
10
32
28
38
30
36
34
26
42
20
22
18
14
12

ADJUSTING DEVICE

FIELD AND BACKGROUND OF THE INVENTION

The invention is concerned with an adjusting device for moving a moveable part into various positions with a spindle drive which is driven by a servomotor and comprises of a spindle having an external thread and of a sleeve part which surrounds said spindle and has an internal thread in engagement with the external thread.

Adjusting devices of this type are used with an electric servomotor in order, for example, to adjust a side ventilator window of a motor vehicle. An adjusting device of this type is disclosed, for example in U.S. Pat. No. 4,186,524. Side ventilator windows of this type are usually coupled to the chassis in a hinged manner in the region of the B-pillar of the motor vehicle and can be brought by the adjusting device from their closed position via intermediate positions into the open position. It is furthermore already known to arrange the servomotor and the spindle drive directly in the region of the moveable part. However, in the case of ventilator windows it has become apparent that even with a very small thread play between the two threads of below 0.1 mm, noise is produced when driving over bad stretches of road with the ventilator window partially open. Particularly in the case of the rear side ventilator windows of motor vehicles these noises are perceived as being particularly annoying because they arise in the vicinity of the occupants' heads.

Further reduction in the thread play is not practical because of the accompanying increase in manufacturing costs.

SUMMARY OF THE INVENTION

The object of the invention is to provide an adjusting device which reduces the tendency to vibrate and therefore reduces the noise being produced.

According to the invention, the object is achieved by an adjusting device of the type described at the beginning, in which one of the two threads consists of two separate threaded parts, and an elastically prestressable element is provided with whose aid an axial force can be produced between the two threaded parts.

In the solution according to the invention, the axial force built up between the two threaded parts with the aid of the elastically prestressable element is supported via the turns of the thread which is in engagement with these two threaded parts. Under the action of the elastically prestressable element on the threaded parts, which can move axially with respect to each other, the thread play is eliminated under certain axial bearing forces of the two threaded parts in a respectively opposite direction. The play-free engagement of the threaded parts with the other thread of the spindle drive stabilizes the moveable part which is to be adjusted, even when there are relatively strong interfering forces which act from outside and may cause vibrations, for example in the case of side ventilator windows of motor vehicles, if the spindle drive is affected by play. With an adjusting device according to the invention, rattling of a partially open side ventilator window need not be feared, even when driving along bad stretches of road.

Although the increased friction of the spindle drive makes a slightly increased torque necessary in order to adjust the moveable part, said torque can be produced by the servomotor without any problems. The friction can also be influenced in a specific manner by the selection of the elastic element or the size of the prestressing force and can be adapted to the particular requirements.

The adjusting device according to the invention furthermore shows the positive side effect that the modulating noise during movement of the moveable part is clearly reduced.

The elastically prestressable element preferably sits between the two threaded parts. Compared to previous solutions, in this structurally particularly simple solution only one further threaded part and the elastically prestressable element are required, and the additional costs can thus be kept low. In a further preferred refinement of the invention, the elastically prestressable element is compressed, so that a tensionable connection between the threaded parts and the elastic element is not required. However, it would in principle also be conceivable to provide tensioned elastic elements, since it is ultimately immaterial as to whether the thread play is eliminated by the two threaded parts being contracted or pressed apart in the axial direction.

In a particularly simple embodiment of the invention, an O-ring or similar spring element made of elastically flexible material is provided as the elastically prestressable element. An O-ring of this type has the further advantage of only taking up very little axial space, and the spindle drive can therefore be kept short.

In a preferred development of the invention, provision is made for the internal thread to be divided, a first threaded part being connected fixedly to the sleeve and the second threaded part being held in an axially moveable manner with respect to said first threaded part. In such an embodiment, only very few changes are necessary in the region of the spindle drive, in comparison with the previous solutions. For example, the second threaded part can principally consist of a commercially available nut. The second threaded part can expediently be secured to the sleeve at at least one point in the circumferential direction in order to maintain a uniform axial force between the threaded parts constantly during operation. An increase in the number of possible relative angular positions between the second threaded part and the sleeve is advantageous, particularly in the case of a short, as compared with the thread pitch, prestressing distance of the elastically prestressable element, in order to be able to set certain axial forces in a specific manner.

The sleeve is furthermore preferably coupled to the moveable part via at least one ball and socket joint. The ball and socket joint makes possible an alignment between the different paths of movement of the sleeve, which acts as a ram, and the moveable part which, for example in the design as a side ventilator window of a motor vehicle, executes a pivoting movement about the B-pillar of the motor vehicle. It has furthermore proven advantageous to provide elastic means between the joint halves of a ball and socket joint, i.e. between the ball head and the ball socket, since even play present in this region increases the tendency to produce noise.

BRIEF DESCRIPTION OF THE DRAWING

The FIGURE shows an adjusting device for a side ventilator window.

In the following text, an exemplary embodiment of the invention is explained in more detail with reference to the attached drawing.

DETAILED DESCRIPTION OF THE PREFERRED EMBODIMENT

The FIGURE shows an adjusting device 10 for a side ventilator window of a motor vehicle. The adjusting device 10 has a housing 12 which accommodates an electric motor 14 and a spindle drive 18 which is coupled to said motor via a step-down gear 16. At the output end the spindle drive has a ram which is guided nonrotatably in the housing 12 in a linearly adjustable manner. The ram 20 is connected via a ball and socket joint (22) to the side ventilator window (not illustrated) and can pivot said window via various intermediate positions from its closed position into a completely opened position or vice versa.

The spindle drive comprises essentially a spindle 24 having an external thread 26 and of a sleeve region 28 which is formed integrally with the ram 20 and has an internal thread 30. The internal thread 30 is composed of a first threaded part 32, which is connected fixedly to the sleeve region 28, and of a second threaded part 36, which is designed as a lock nut 34. The lock nut 34 is held in the sleeve region 28 in an axially displaceable and nonrotatable manner. Because it is guided in this manner, the two threaded parts 32, 36 can be displaced axially with respect to each other until they are in engagement in a play-free manner with the external thread 26 of the spindle 24. Between the two threaded parts 32, 36 a rubber ring 38 or otherwise resilient element is provided.

The spindle 24 is furthermore provided with a toothed wheel 40 which can be formed integrally with the spindle body and is in engagement with a pinion (not illustrated) of the electric motor 14; the pinion of the electric motor 14 and the toothed wheel 40 forming the step-down gear 16. The spindle 24 is formed at both ends with bearings 42 via which it is mounted rotatably in the housing 12.

The geometry of the two threaded parts 32, 36 and of the rubber ring 38 is selected in such a manner that said rubber ring is prestressed in compression by a certain extent if the two threaded parts 32, 36 are in engagement with the external thread 26 of the spindle 24. In the process, the rubber ring 38 produces an axial compression force which acts between the lock nut 34 and the sleeve region 28 and attempts to enlarge the axial distance between these two parts. However, because of the threaded engagement the two threaded parts 32, 36 bear in a respectively opposite direction against the corresponding flanks of the external thread 26, resulting under the prestressing force in a play-free fit of the unit containing the two threaded parts 32, 36 and comprising the sleeve region 28 and lock nut 34 on the external thread 26 of the spindle 24. This prestressed fit prevents forces, as can be produced, for example when driving along poor stretches of road, and which are introduced via the ball and socket joint 22 from being able to cause axial movements of the ram 20, which, in conjunction with the side ventilator window which vibrates at the same time, could result in an annoying noise being produced. The adjusting device 10 which is illustrated therefore operates with substantially less noise in operation than a comparable adjusting device which is in engagement with the external thread of the spindle just via a single, rigidly formed threaded part and without a lock nut.

In order to avoid noise being produced in the region of the ball and socket joint 22, elastic means are provided between the ball head and ball socket thereof (neither are visible), which means are likewise slightly prestressed and therefore prevent play between the two joint halves.

Instead of the embodiment illustrated having a compressed rubber ring 38, a tensioned elastic element between the two threaded parts 32, 36 is readily conceivable, in which case, however, a tensionable connection has to be provided between this elastic element and the two threaded parts 32, 36.

Instead of dividing the internal thread 30, it is also readily conceivable to subdivide the external thread 26 of the spindle 24 into two axial parts which engage under axial prestress in a corresponding manner in an internal thread, which is then formed in a continuously rigid manner, in the sleeve region 28.

A reverse arrangement of the spindle drive 18 with a driven sleeve region and axially shifted spindle is also readily conceivable.

We claim:

1. An adjusting device for moving a moveable part into various positions with a spindle drive (18) which is driven by a servomotor (14) and comprises essentially a spindle (24) having an external thread (26) and a sleeve part (20, 28) which surrounds said spindle and having an internal thread (30) in engagement with the external thread (26), wherein one (30) of the two threads comprises two separate threaded parts (32, 36), and an elastically prestressable element (38) is provided by which an axial force is produceable between the two threaded parts (32, 36), wherein said elastically prestressable element (38) sits between the two threaded parts (32, 36).

2. The adjusting device as claimed in claim 1, wherein the servomotor (14) drives the spindle (24) directly or via a step-down gear (16).

3. The adjusting device as claimed in claim 1, wherein said elastically prestressable element (38) is compressed.

4. The adjusting device as claimed in claim 3, wherein said elastically prestressable element is an O-ring (38) or a resilient element made of elastically flexible material.

5. The adjusting device as claimed in claim 1, wherein the internal thread (30) comprises said two separate threaded parts, a first of said two threaded parts (32) being connected fixedly to the sleeve part (28) and the second of said two threaded parts (36) being held in an axially moveable manner with respect to said first threaded part (32).

6. The adjusting device as claimed in claim 5, wherein the second threaded part (34, 36) is securable to the sleeve part (28) at at least one relative position in circumferential direction.

7. An adjusting device comprising a moveable part movable into various positions; a spindle drive (18) driven by a servomotor (14) and comprises essentially a spindle (24) having an external thread (26) and a sleeve part (20, 28) which surrounds said spindle and having an internal thread (30) in engagement with the external thread (26), wherein one (30) of the two threads comprises two separate threaded parts (32, 36), and an elastically prestressable element (38) is provided by which an axial force is produceable between the two threaded parts (32, 36), wherein the servomotor is an electric motor (14), and the movable part is a ventillator window of a motor vehicle.

8. An adjusting device comprising a moveable part movable into various positions; a spindle drive (18) driven by a servomotor (14) and comprises essentially a spindle (24) having an external thread (26) and a sleeve part (20, 28) which surrounds said spindle and having an internal thread (30) in engagement with the external thread (26), wherein one (30) of the two threads comprises two separate threaded parts (32, 36), and an elastically prestressable element (38) is provided by which an axial force is produceable between the two threaded parts (32, 36), wherein the sleeve part (20, 28) is coupled to the moveable part.

9. The adjusting device as claimed in claim 8, wherein the sleeve part (20, 28) is coupled to the moveable part via at least one ball and socket joint (22).

10. The adjusting device as claimed in claim 9, wherein an elastic element is provided at least between joint halves of said at least one ball and socket joint (22).

* * * * *